United States Patent [19]

Wruck et al.

[11] Patent Number: 5,033,126

[45] Date of Patent: Jul. 23, 1991

[54] LEG WARMERS

[76] Inventors: Wade Wruck; Brent Wruck, both of P.O. Box 141101, Anchorage, Ak. 99514

[21] Appl. No.: 493,951

[22] Filed: Mar. 15, 1990

[51] Int. Cl.[5] ..... A41D 17/02; A41D 3/06

[52] U.S. Cl. ..... 2/242; 2/22; 2/46; 2/227

[58] Field of Search ..... 2/242, 22, 23, 46, 62, 2/82, 227, 231, 232

[56] References Cited

U.S. PATENT DOCUMENTS

| | | | |
|---|---|---|---|
| Re. 32,506 | 9/1987 | Hightower, Jr. | 2/22 |
| D. 201,861 | 8/1965 | Cummins | 2/22 |
| D. 290,302 | 6/1987 | Campbell | 36/2 R |
| 1,930,748 | 10/1933 | Giorda | 36/2 |
| 2,014,208 | 9/1935 | Parvin | 36/2 |
| 3,538,914 | 11/1970 | Myers | 128/165 |
| 3,758,963 | 9/1973 | Knight | 36/2 |
| 4,110,845 | 9/1978 | Chellis | 2/62 |
| 4,382,301 | 5/1983 | Hightower, Jr. | 2/22 |
| 4,599,812 | 7/1986 | Harmsen | 2/239 |
| 4,622,697 | 11/1986 | Tajima | 2/242 |
| 4,697,286 | 10/1987 | Cho | 2/22 |
| 4,716,596 | 1/1988 | Hofman | 2/69 |

FOREIGN PATENT DOCUMENTS

| | | | |
|---|---|---|---|
| 892301 | 2/1972 | Canada | 2/231 |

OTHER PUBLICATIONS

*Easy Rider* Magazine Advertisement FIG. C and Applicable Photos of "Rough Rider Chaps".

*Primary Examiner*—Werner H. Schroeder
*Assistant Examiner*—Gloria Hale
*Attorney, Agent, or Firm*—Hughes & Multer

[57] ABSTRACT

Leg warmers which include a panel having at least one layer of thermal insulation and a closure system. The panel is designated to wrap around the wearer's leg from foot to crotch, and the closure system provides an essentially moisture and airtight seam between the edges of the panel. The leg warmers feature: (1) the combination of a zipper-type fastener and a pile- or snap-type fastener which holds the leg warmer on the wearer's leg, making it easier to start and close the zipper; (2) multiple zipper slides which also make it easy to provide ventilation; (3) pile-type fasteners at the bottom of the leg warmer which allows it to be adjusted to a snug, air, snow, and moisture excluding fit with the wearer's leg; (4) an adjustable suspender for attaching the leg warmer to the wearer's belt and thereby holding it up; and (5) various combinations of the foregoing, innovative features.

12 Claims, 3 Drawing Sheets

LEG WARMERS

TECHNICAL FIELD OF THE INVENTION

The present invention relates to leg warmers and, more specifically, to novel, improved leg warmers which are designed for use out-of-doors, provide superior protection from wind and cold, and have a fastening systems that allows them to be easily donned and doffed.

BACKGROUND OF THE INVENTION

A number of leg warmers and other superficially similar items of apparel such as leggings and snakeproof chaps have heretofore been proposed. Those of which we are aware are disclosed in: (a) U.S. Pat. No. 1,930,748 issued Oct. 17, 1933 to Giorda for TROUSERS PROTECTOR; U.S. Pat. No. 2,014,208 issued Sept. 10, 1935 to Parvin for FANG PROOF LEGGING; U.S. Pat. No. 3,538,914 issued Nov. 10, 1970 to Myers for ADJUSTABLE FASTENING DEVICE; U.S. Pat. No. 3,758,963 issued Sept. 18, 1973 to Knight for SNAKE BITE PREVENTING DEVICE; U.S. Pat. No. 4,110,845 issued Sept. 5, 1978 to Chellis for RAIN CHAPES; U.S. Pat. No. 4,382,301 issued May 10, 1983 to Hightower, Jr. for SNAKE PROOF CHAPS; U.S. Pat. No. 4,599,812 issued July 15, 1986 to Harmsen for LEGGINGS; U.S. Pat. No. 4,697,286 issued Oct. 6, 1987 to Cho for PROTECTIVE THIGH AND KNEE GEAR; and U.S. Pat. No. 4,716,596 issued Jan. 5, 1988 to Hofman for GARMENTS; (2) a reissue of above-cited patent U.S. Pat. No. 4,382,301 (U.S. Pat. No. Re. 32,506 dated Sept. 22, 1987); (3) design patent U.S. Pat. No. Des. No. 290,302 issued June 16, 1987 to Campbell for LEG WARMER; and (4) an advertisement from Easy Riders magazine.

Many of the items of apparel disclosed in the foregoing references would not be capable of keeping a wearer's legs warm and protected from wind because of their cut and/or the materials from which they are fabricated.

The above-cited Giorda, Myers, Knight, Chellis, Hightower, Jr., Harmsen, Cho, Hofman, and Campbell patents, for example, disclose items of apparel which would not be useful as leg warmers because of the limited coverage of the wearer's legs they provide.

And, of all of the items of apparel disclosed in the cited references, only those disclosed in the Campbell and Harmsen patents would appear to be made of materials providing any significant protection from the cold. The leg warmers disclosed in the Harmsen patent are nonetheless of limited utility because their integral footwear would make it impractical to wear them out-of-doors, especially in circumstances involving travel on wet, snow covered, or muddy terrain.

Yet another drawback common to a number of the heretofore patented leg coverings—e.g., those disclosed in the Parvin and Garland references—is that they are made of inflexible metals or have major components fabricated from inflexible materials. As a consequence, such leg coverings would not afford the freedom of movement required in many, if not most, circumstances in which leg warmers can be put to good use. Fishermen, construction workers, sportmen, and others, all require more mobility than these leg coverings would provide.

Still another, and very important, drawback of the prior art leg covers is that they employ fastening systems which are inadequate because, if used in leg warmers, they would make it too difficult to put the leg warmers on and then take them off. Also, in the case of those disclosed in the Harmsen and Cho patents, for example, one part of the disclosed leg covering can separate from the cooperating, underlying part in at least localized areas, leaving an unintended gap therebetween. This would be quite undesirable in a leg warmer as cold air could penetrate through the gaps even if that was not wanted. Furthermore, in most cases, no provision is made for adjusting the previously disclosed leg coverings to fit the lower leg of the particular wearer. This feature, though perhaps not absolutely essential, is obviously a highly desirable option. A snug fit will exclude cold air, snow, and moisture and thereby keep the wearer more comfortable.

SUMMARY OF THE INVENTION

There have now been invented, and disclosed herein, certain new and novel leg warmers which do not have the above-discussed, and other, disadvantages of heretofore proposed leg warmers. Nor do they have the also above-discussed disadvantages which other previously disclosed leg coverings would have if one attempted to employ them as leg warmers or to incorporate their features in leg warmers.

Generally speaking, the novel leg warmers disclosed herein include a wrap around panel having at least one layer of thermal insulation and a closure system. After the panel has been wrapped around the wearer's leg, the closure system is employed to join the two vertically extending edges of the panel together and thereby secure the leg warmer to the wearer's leg in an essentially snow, moisture, and airtight relationship. A suspender at the upper end of the leg warmer is attached to the wearer's belt to keep the leg warmer from slipping after it has been donned.

The leg warmers of the present invention have a unique cut which results in their keeping the wearer's leg warm from crotch to foot. At the same time, this cut furnishes ready access to the front and rear pockets of the pants or trousers over which the leg warmers are typically worn.

The leg warmers disclosed herein are designed to withstand heavy use out-of-doors by fishermen, construction workers, sportsmen, and other persons. To this end, their wrap around panels are preferably fabricated of a durable, wear resistant material. They may also be designed to resist penetration by rain and other moisture, snow, mud, etc.

Also, to the same end, the leg warmers of the present invention may be equipped with a closure system providing an adjustable fastener at the lower end of the leg warmer. This allows the bottom of the leg warmer to be snugly fitted to the wearer's leg, thereby excluding air, moisture, snow, and the like.

Closure systems employing zippers are preferable to the extent that they can be partially opened to provide ventilation if the wearer becomes too warm. A single zipper with dual slides can be employed. This allows two ventilation gaps to be created. If a zipper is employed in the leg warmer closure system, an additional fastener of the snap- or pile-type is preferably provided at the top of the leg warmer. This fastener is connected up first, securing the leg warmer to the wearer's leg. This facilitates the starting and closing of the zipper.

Another type of closure system that can be employed in the leg warmers of the present invention makes use of cooperating, vertically extending strips of a pile-type fastener material at the opposite edges of the leg warmer and extending from its top end to its bottom end. While not as efficacious as zipper-type fasteners in providing ventilation, those of the character just described do have the advantage of being easy to secure to the wearer's leg at their upper end. They also provide an adjustment at the bottom end of the leg warmer which allows the above-discussed snug fit to be obtained.

OBJECTS OF THE INVENTION

From the foregoing, it will be apparent that the provision of novel, improved, leg warmers is one primary and important object of the invention.

Other, also important, but more specific objects of the invention include the provision of leg warmers:

which are easy to put on, even over bulky work clothes, and equally easy to subsequently take off;

which do not restrict or otherwise impede the wearer's movements;

which are particularly suited for use in demanding out-of-doors applications; which extend from the wearer's foot to the wearer's crotch and can be made essentially snow, moisture, and airtight over this span;

which have a fastener at the bottom end thereof that allows the leg warmer to be adjusted into a snug, air excluding fit with the wearer's leg;

which have a suspender for attaching the leg warmer to a wearer's belt and thereby keeping it from slipping down;

which include a wrap around panel and a closure system for securing vertically extending edges of the panel together after the panel has been wrapped around the wearer's leg;

which, in conjunction with the preceding object, employ a closure system which includes a zipper and a fastener at the top end of the leg warmer which can be connected up first to hold the leg warmer to the wearer's leg and make it easier to start and close the zipper;

which, in conjunction with the preceding object, are so constructed that the zipper can be partially opened to provide one or more ventilation gaps without the leg warmer becoming loose, falling off, etc.; and which have various combinations of the just-enumerated, innovative features.

Other important objects and features and additional advantages of the invention will be apparent to the reader from the foregoing and the appended claims and as the ensuing detailed description and discussion proceeds in conjunction with the accompanying drawing.

BRIEF DESCRIPTION OF THE DRAWING

In the drawing:

FIG. 1 shows how a leg warmer embodying the principles of the present invention appears and fits after it has been put on;

DETAILED DESCRIPTION OF THE INVENTION

Figure 1:
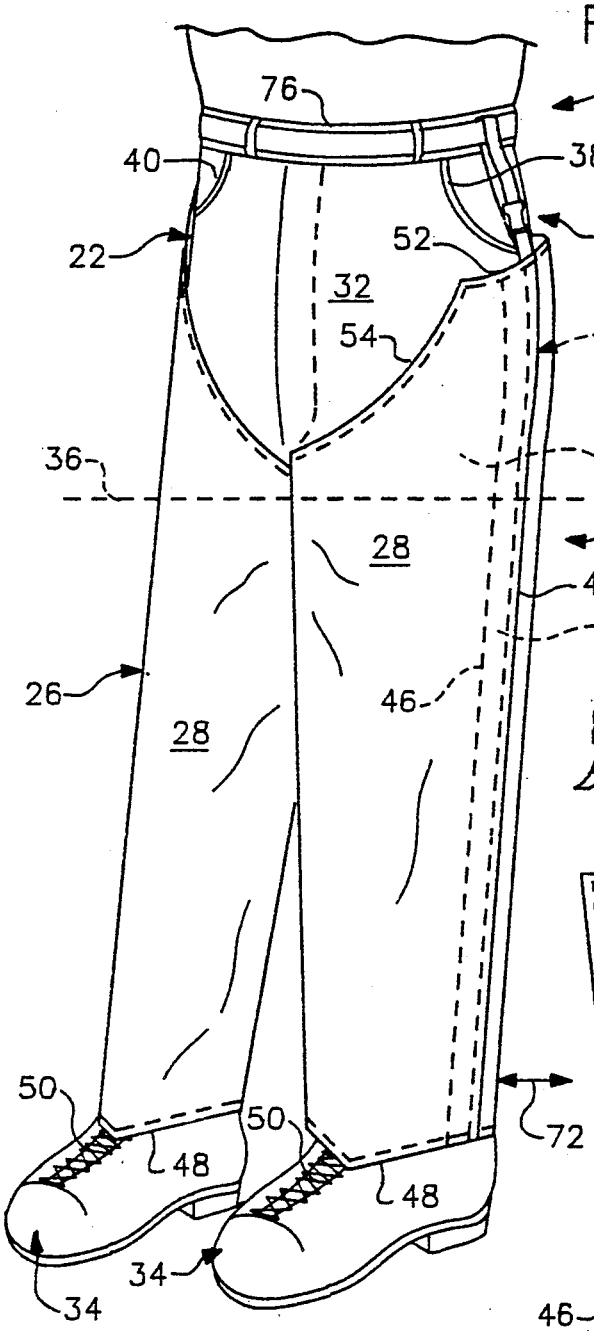

Referring now to the drawing, FIG. 1 depicts the lower body 20 of an individual wearing trousers 22 and leg warmers 24 and 26. Leg warmers 24 and 26 are constructed in accord with, and embody, the principles of the present invention. The two leg warmers differ only that they are cut in a right and left, mirror image relationship.

Because of the close similarity of the two leg warmers 24 and 26, only leg warmer 24 will be described in detail herein. It is to be understood that this description is equally applicable to leg warmer 26.

Figure 2:
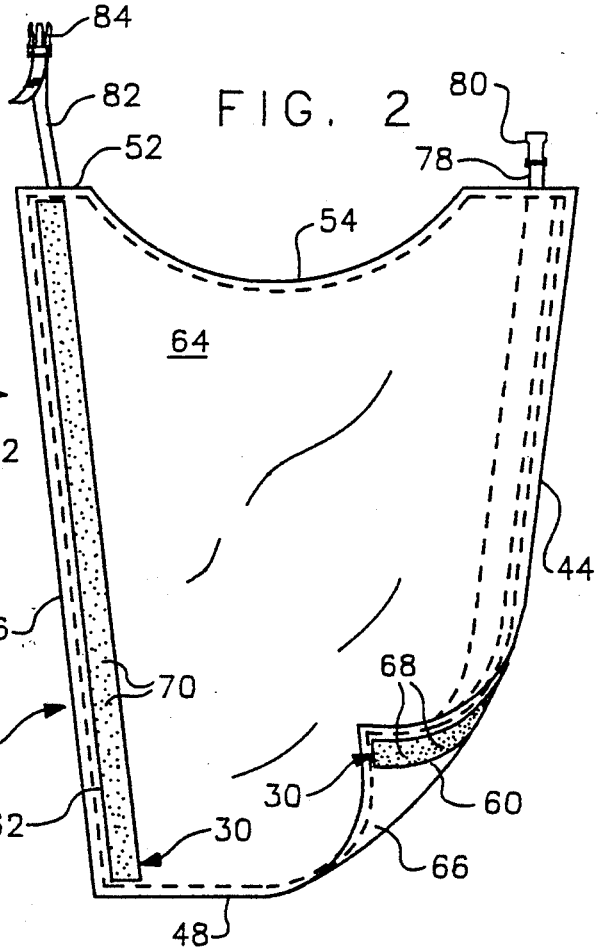
FIG. 2 shows how the leg warmer appears before it is donned.

Referring again to the drawing, and more specifically, to FIG. 2, leg warmer 24 includes a wrap around panel 28 and a closure system 30. Panel 28 is cut and dimensioned to extend from the crotch 32 of the wearer to the top of the wearer's footgear 34 and thereby keep the wearer's entire leg warm. It is to be noted, in this respect, that a jacket or other outer garment (not shown) will normally be worn with leg warmer 24. This garment will typically extend down to the level indicated by horizontal, dotted line 36 in FIG. 1 to keep all of the wearer's body above leg warmer 24 covered. The illustrated cut of leg warmer 24 also allows the individual wearing the leg warmer to easily reach into the front pockets 38 and 40 and the back pockets of trousers 22. One of these back pockets is illustrated in each of FIGS. 3–7 and identified by reference character 42.

Referring back to FIG. 2, wrap around leg warmer panel 28 has vertically extending side edges 44 and 46, a square cut bottom end 48 designed to fit against the top 50 of the wearer's boots or shoes 34 as shown in FIG. 1, and a top or upper end 52 with a scallop 54 which accommodates the wearer's crotch 32 and seat 55.

The wrap around panel 28 of leg warmer 24 may be of single or multi-ply construction. The single ply—or at least one ply of a multi-ply panel—is fabricated from a material capable of providing thermal insulation. Many such materials are commercially available, and any suitable one of these may be employed. The main requirements are that the selected material provide adequate thermal insulation and that it—along with all other plys of a multi-ply panel—be very flexible. This is required so that the leg warmer will not restrict or otherwise interfere with the movement of those active wearers for which the leg warmers of the present invention are primarily, although not exclusively, intended. Also, the one ply of a single ply panel or the outer ply of a multi-ply panel can be made of a material which is impervious or otherwise resistant to penetration by air, moisture, snow, and other substances which might cause discomfort to the wearer.

Leg warmer 24 is put on by wrapping its panel 28 around the wearer's leg 56 with the vertically extending edges 44 and 46 of the panel overlapped on the outer side of the leg as shown in FIG. 1. The two edges 44 and 46 of the panel are then joined together over the entire span from the bottom 48 to the top 52 of the leg warmer panel 28 by closure system 30 to provide an essentially air, snow, and moisturetight joint 58 between these two edges of panel 28.

Returning now to FIG. 2, the just-referred-to closure system 30 of leg warmer 24 includes two, elongated, pile-type fasteners 60 and 62. These fasteners may be of the Velcro® type.

Fasteners 60 and 62 are sewn or adhesively bonded to the opposite sides 64 and 66 of panel 28 with the interengageable piles 68 and 70 of fasteners 60 and 62 exposed and opposite each other. Fastener 60 extends from the bottom 48 to top 52 of leg warmer 24 along edge 44. Cooperating fastener 62 similarly extends from the bottom to the top of the leg warmer, in this case along the opposite edge 46 of panel 28.

Once leg warmer 24 has been wrapped around the leg 56 of the wearer in the manner discussed above, the edge 44 of panel 28 is pressed against the edge 46 of the panel, engaging the cooperating piles 68 and 70 of fasteners 60 and 62 to form the penetration-resistant seam or joint 58 previously described.

Closure system 30 has the advantage that fasteners 60 and 62 are easily connected together, making the putting on of leg warmer 24 a simple and easily accomplished task. This is not the case when the leg warmer has to be pulled up over the wearer's trousers 22 as is necessary in many heretofore proposed leg coverings, including most of those discussed above. This is especially true when trousers 22 are heavy and bulky as they are for out-of-door use in cold weather. Also, the two fasteners 60 and 62 can be adjusted relatively to each other as suggested by arrow 72 in FIG. 1 to vary the circumference of the leg warmer and thereby make the leg warmer snugly fit the wearer's leg 56 at the bottom end 48 of the leg warmer.

A final, and also important, component of leg warmer 24 is an adjustable suspender 74 for attaching the leg warmer to the wearer's belt 76. This keeps the leg warmer in place, even as the wearer engages in strenuous activity.

Suspender 74 is of conventional construction and will therefore not be described in any great detail herein. Briefly, however, and as is best shown in FIG. 2, suspender 74 includes: (1) a strap 78 sewn or otherwise fastened to the top end 52 of leg warmer panel 28 adjacent edge 44, (2) a clasp element 80 fixed to strap 78, (3) a second strap 82 similarly attached to the top end 52 of panel 28 adjacent edge 46, and (4) a cooperating clasp element 84 through which strap 82 can be threaded to increase and decrease the strap length and, therefore, the length of suspender 74. Once the leg warmer has been put on, strap 82 is threaded around the wearer's belt 76 and clasp element 84 then hooked to clasp element 80 (see FIG. 1) to complete the donning of leg warmer 24.

Leg warmer 24 is taken off by reversing the just-described process; viz., by unhooking suspender 74, pulling fastener 60 loose from cooperating fastener 62, and then removing the leg warmer.

An identical procedure is employed to put on and take off cooperating leg warmer 26.

The detailed description and discussion which follows is devoted primarily to other embodiments of the present invention. To a large extent, these resemble the leg warmers 24 and 26 illustrated in FIGS. 1 and 2 and discussed above. To the extent that this true, the same reference characters have been employed to identify like components of the several leg warmers.

Figures 3, 4, 5, 6:
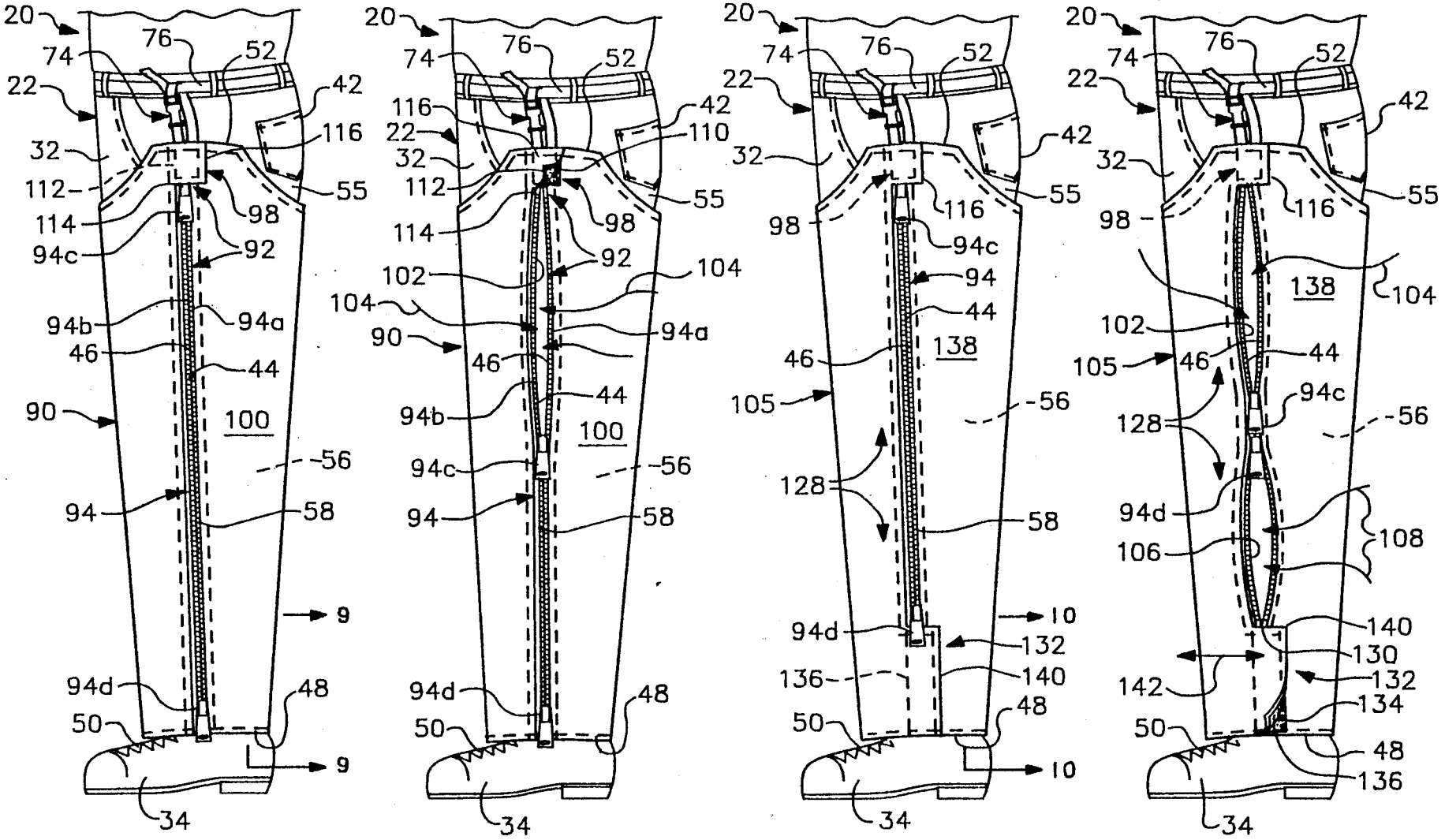
FIG. 3 is a side view of a wearer's lower body and a second form of leg warmer which also embodies the principles of the present invention and features a zipper-type fastener and a pile-type fastener which is connected up first to hold the leg warmer in place on the wearer's leg and thereby make it easier to start and close the zipper-type fastener.
FIG. 4 is a view, similar to FIG. 3, of the leg warmer shown in the latter figure with the zipper fastener partially opened to provide a ventilation gap.
FIG. 5 is a view similar to FIG. 3, showing yet another leg warmer in accord with the principles of the present invention, in this case a leg warmer which features a pile-type fastener at the bottom of the leg warmer, allowing it to be adjusted to the wearer's leg with a snug, snow, moisture, and air excluding fit.
FIG. 6 is a view, similar to FIG. 5, of the leg warmer shown in FIG. 5 with a dual slide-type fastener of the leg warmer's closure system opened to provide two ventilation gaps.

Returning then to the drawing, FIGS. 3 and 4 depict a leg warmer 90 which differs from leg warmers 24 and 26 primarily in the type of closure system it employs. The closure system of leg warmer 90 is identified by reference character 92. It includes a zipper-type fastener 94 and a pile-type fastener 98. Fastener 94 extends upwardly from the bottom end 48 of leg warmer panel 100. Fastener 98 is located above fastener 94 and extends from it to the top end 52 of the leg warmer panel.

Zipper-type fastener 94 is of conventional construction. It has two cooperating rows 94*a* and 94*b* of interengageable teeth and a pair of lower and upper slides or sliders 94*c* and 94*d* for engaging and releasing those teeth. As can be seen by comparing FIGS. 3 and 4, the two rows 94*a* and 94*b* of zipper teeth are engaged to join the two edges 44 and 46 of leg warmer 90 together by moving lower slide 94*c* in a downward direction and by moving upper slide 94*d* in the opposite direction. Conversely, by moving slide 94*d* in a downward direction, a gap 102 of selected length can be left between the two edges 44 and 46 of leg warmer panel 100. That ventilates leg warmer 90 as indicated by arrows 104 in FIG. 4.

As shown in FIG. 6, which depicts a third leg warmer 105 with a zipper-type fastener 94, a second ventilation gap 106 between leg warmer edges 44 and 46 can be provided by displacing zipper slide 94*c* in an upward direction. This affords ventilation in the area and in the pattern suggested by arrows 108 in FIG. 6 in addition to, or in place of ventilation, as indicated by arrows 104.

The dual zipper slides 94*c* and 94*d* allow the ventilation gap 102 (or gaps 102 and 106) to be provided without the leg warmer 90 becoming loose because the edges 44 and 46 of the leg warmer remain joined at the top and bottom ends 48 and 52 of the leg warmer and over the major part of its length.

Referring again to FIG. 4, the pile-type fastener 98 is employed in leg warmer 90 to make it easier to start and close zipper-type fastener 94 (this requires that the two edges 44 and 46 of the leg warmer panel 100 be brought together and the apposite ends of the two interengageable zipper teeth rows 94*a* and 94*b* aligned). Pile-type fastener 98 is connected up first to hold leg warmer 90 in place after panel 100 is wrapped around the wearer's leg with the two rows 94 and 94*b* aligned and the wearer's hands free. It includes cooperating, typically like configured and dimensioned, fastener elements which are patches 110 and 112 of pile-type fastener material. Fastener element 110 extends from the upper end 114 of zipper 94 to the top end 52 of leg warmer 90. It is sewn, adhesively bonded, or otherwise attached to leg warmer panel 100 adjacent the edge 44 of that panel.

The cooperating fastener element 112 is similarly fixed to a flap 116 which is joined to or integral with leg warmer panel 100 and is extendable or displaceable into overlying relationship with fastener element 110. Fastener element 112 is affixed to that side of flap 116 facing fastener element 110. Therefore, by pressing flap 116 against the wearer's leg 56 after the leg warmer 90 has been wrapped around the wearer's leg, the two fastener elements can be connected or engaged to hold leg warmer 90 in place in the manner and for the purposes just described.

Figure 9:
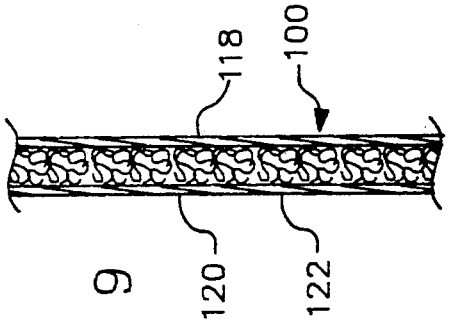
FIG. 9 is a section through the leg warmer of FIG. 3, taken substantially along line 9—9 of the latter figure.

The panel 100 of leg warmer 90 has a three-ply construction which is shown in FIG. 9. All three plys 118, 120, and 122 are of flexible materials which will not limit or interfere with the wearer's movement. Outer ply 118 is preferably wear-resistant and typically a material which will offer resistance to penetration by cold air and moisture or one which can be treated to give it those properties. Central ply 120 is selected for its thermal insulating capabilities, and inner ply 122 is typically chosen for its ability to protect thermal insulation layer 120 while affording comfort to the wearer.

It was pointed out above that leg warmers of the character described herein may also have a closure system which allows the lower end of the leg warmer to be snugly fitted to the wearer's legs, thereby excluding drafts, moisture, snow, etc. A closure system with this capability as well as those of the closure system 92 illustrated in FIGS. 3 and 4 and just described is employed in the leg warmer 105 illustrated in FIGS. 5 and 6. The closure system is identified in these figures, to which reference is now made, by reference character 128.

In closure system 128, a shorter zipper 94 is employed so that the lower end 130 of the zipper will lie above the bottom end 48 of leg warmer 105. Beneath zipper 94 in this embodiment of the invention is a second, pile-type fastener 132. This fastener is employed in a manner akin to that discussed above in conjunction with leg warmer 24 to snugly fit the bottom end 48 of leg warmer 105 to the wearer's leg 56.

As can be seen from FIG. 6, fastener 132 includes two cooperating elements 134 and 136, each an elongated, vertically oriented strip or rectangle of pile-type fastener material extending from the lower end 130 of zipper-type fastener 94 to the bottom 48 of leg warmer 105. One fastener element 134 is affixed to the wrap around panel 138 of leg warmer 105 adjacent vertical edge 44 of the panel. Joined to, or integral with, panel 138 at the bottom end thereof and extending laterally from the cooperating, vertical edge 46 of the panel is a flap 140 dimensioned and configured to overlie fastener element 134. The second fastener element 136 is attached to that side of flap 140 facing fastener element in a comparable vertical orientation. Consequently, as indicated by double-headed arrow 142 in FIG. 6, fastener element 136 can be displaced with respect to fastener element 134 to adjust the circumference of leg warmer 105 at its bottom end 48 and thereby provide the desired snug fit with the leg 56 of the wearer.

Figure 10:
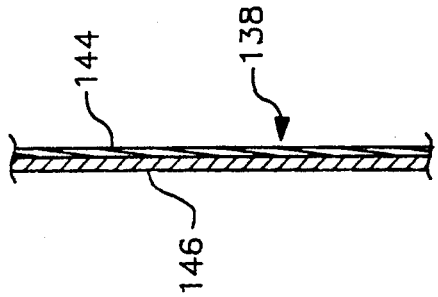
FIG. 10 is a section through the leg warmer of FIG. 5, taken substantially along line 10—10 of FIG. 5.

As is shown in FIG. 10, a two-ply construction is employed in the panel 138 of leg warmer 105. The outer ply 144 is again preferably selected for its resistance to wear and/or moisture, snow, and wind. A primary consideration in selecting the material for inner ply 146 is thermal insulation.

Figure 7:
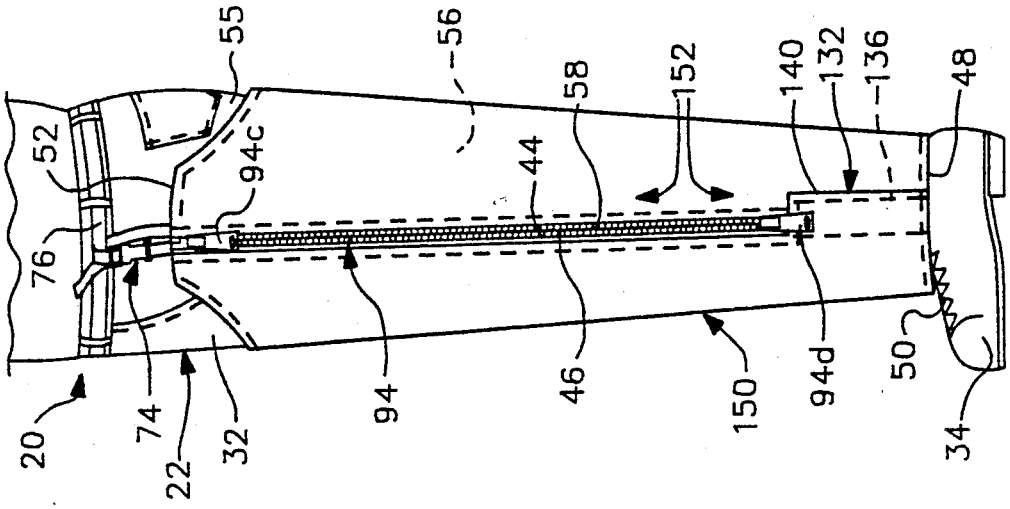
FIG. 7 is a view, similar to FIG. 6, of an embodiment of the invention which differs from the FIG. 6 embodiment primarily in that the FIG. 7 embodiment does not have a pile-type fastener at its upper end.

Yet another leg warmer embodying the principles of the present invention is depicted in FIG. 7 and identified by reference character 150. This leg warmer employs a closure system 152 which is like the closure system 128 illustrated in FIGS. 5 and 6 and just discussed except that the upper, pile-type fastener 98 is not employed; i.e., only the zipper-type fastener 94 and lower, snug fit facilitating, pile-type fastener 132 are utilized. Also, the length of fastener 94 is increased to that fastener will extend from pile-type fastener 132 to the top end 52 of leg warmer 150.

Leg warmer 150 has the advantage of being simpler than leg warmer 105 and, consequently, less expensive to produce.

Figure 8:
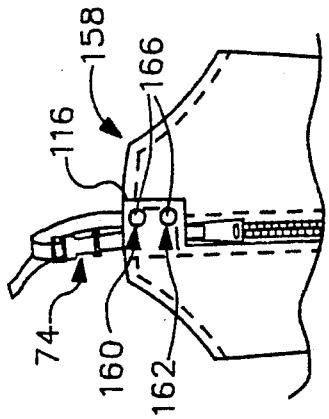
FIG. 8 is a fragmentary view of a leg warmer in accord with the principles of the present invention which differs from those embodiments illustrated in FIGS. 3–6 in that the pile-type fastener at the upper end of the leg warmer has been replaced with a snap-type fastener.
Figure 8A:
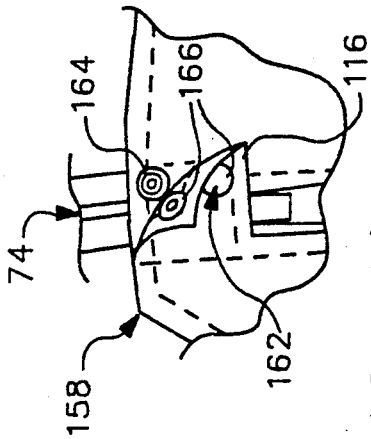
FIG. 8A is a fragment of FIG. 8 to a larger scale and with a flap employed in the FIG. 8 leg warmer folded back to show details of a snap-type fastener employed in that leg warmer.

FIGS. 8 and 8A show that the use of a pile-type fastener as depicted in FIGS. 3–6 as an aid to the putting on of leg warmers embodying the principles of the present invention is not essential. Other types of fasteners can instead be employed, if desired. For example, the leg warmer 158 illustrated in the just-mentioned figures employs snap-type fasteners 160 and 162. Each of these fasteners includes: (1) a male fastener element 164 attached to the wrap around panel 166 of the leg warmer adjacent the edge 44 of that panel and at the top end 52 thereof; and (2) a cooperating, female fastener element 166 attached to, and extending through, a flap 116 at the upper end of the leg warmer panel (flap 116 is described above and also illustrated in FIGS. 3–6).

The invention may be embodied in forms other than that disclosed above without departing from the spirit or essential characteristics of the invention. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. A leg warmer which comprises:

a wrap around panel dimensioned to extend from the foot to the crotch of the wearer and to completely surround the wearer's leg, said panel being fabricated entirely of flexible materials, comprising at least one layer of thermal insulation, and having a top end and a bottom end and first and second, completely separable edges extending from the bottom end to the top end of the panel; and a closure system for so continuously joining the vertically extending edges of said panel together that said panel can be wrapped around the wearer's leg and said closure system then employed to provide a seam which is resistant to the passage of cold air and moisture between the first and second, vertically extending edges of the panel from the bottom end of the leg warmer to the top end thereof, said closure system including a first means for joining the two edges of the panel together over the major portion of the leg warmer length and fastener means above said first closure system means and extending from the first closure system means to the top end of the panel for fastening the first and second edges of the panel together at said top end after the panel has been wrapped around the wearer's upper leg and before the edges of the panel are joined together by the first closure system means, thereby facilitating the donning of the leg warmer and the manipulation of the first closure system means by fixing the edges of the panel together and holding the leg warmer to the upper part of the wearer's leg.

2. A leg warmer as defined in claim 1 in which the fastener means incorporated in said closure system at the top end of the panel includes a first patch of a pile-type fastener material fixed to said panel at the first edge thereof and extending from the first closure system means to the top end of the panel, a flap extendable from the second edge of the panel into overlying relationship with said first patch of pile-type fastener material, and a second, cooperating patch of pile-type fastener material on that side of the flap facing said first patch.

3. A leg warmer as defined in claim 1 in which the means incorporated in said closure system at the top end of the panel to fasten the first and second edges of the panel together and hold the leg warmer to the wearer's leg comprises at least one snap-type fastener, said fastener having a male component and a female component, one of said components being fixed to said panel at the top end of said panel and at the first edge thereof, said leg warmer also including a flap extendable from the second edge of the panel into overlying relationship with said one snap-type fastener component, and the other of the snap-type fastener components being attached to that side of the flap facing said one component.

4. A leg warmer as defined in claim 1 which has means at the bottom end of said panel for adjusting the circumference of the leg warmer and thereby providing a snug fit between the leg warmer and a wearer's leg, thus keeping air, moisture, snow, and the like from penetrating through the bottom end of the leg warmer.

5. A leg warmer as defined in claim 4 in which the means providing the snug fit at the bottom end of the leg warmer comprises a first, elongated, vertically extending patch of a pile-type fastener material extending upwardly from the bottom of the panel at the first edge thereof, a flap extendable from the second edge of the panel into overlying relationship with said first patch of pile-type fastener material, and a second, cooperating, also elongated and vertically extending patch of pile-type fastener material fixed to that side of the flap facing the first patch of pile-type fastener material.

6. A leg warmer as defined in claim 1 in which the first closure system means is a zipper with two slides, a first row of teeth extending along the first edge of the panel, and a second row of teeth extending along the second edge of the panel, said slides being vertically and independently displaceable relative to said panel to interengage and disengage the teeth of the first and second rows so that one or both of said slides can be so manipulated as to disengage selected segments of said rows of teeth and thereby provide a ventilation gap or gaps through which air can circulate to the leg of the wearer.

7. A leg warmer as defined in claim 6 which has means at the bottom end of said panel for adjusting the circumference of the leg warmer and thereby providing a snug fit between the leg warmer and a wearer's leg, thus keeping air, moisture, snow, and the like from penetrating through the bottom end of the leg warmer.

8. A leg warmer as defined in claim 7 in which the means providing the snug fit at the bottom end of the leg warmer comprises a first, elongated, vertically extending patch of a pile-type fastener material extending upwardly from the bottom of the panel at the first edge thereof, a flap extendable from the second edge of the panel into overlying relationship with said first patch of pile-type fastener material, and a second, cooperating, also elongated and vertically extending patch of pile-type fastener material fixed to that side of the flap facing the first patch of pile-type fastener material.

9. A leg warmer which comprises:

a wrap around panel dimensioned to extend from the foot to the crotch of the wearer and to completely surround the wearer's leg, said panel being fabricated entirely of flexible materials, comprising at least one layer of thermal insulation, and having a top end and a bottom end and first and second, completely separable edges extending from the bottom end to the top end of the panel;

a closure system for so continuously joining the vertically extending edges of said panel together that said panel can be wrapped around the wearer's leg and said closure system then employed to provide a seam which is resistant to the passage of cold air and moisture between the first and second, vertically extending edges of the panel from the bottom end of the leg warmer to the top end thereof, said closure system including first means fixed to said panel at the first edge of the panel and extending downwardly toward the bottom end of the panel and second, cooperating means fixed to the panel at the second edge thereof and also extending downwardly toward the bottom end of the panel; and means at the bottom end of said panel for adjusting the circumference of the leg warmer and thereby providing a snug fit between the leg warmer and a wearer's leg, thus keeping air, moisture, snow, and the like from penetrating through the bottom end of the leg warmer.

10. A leg warmer as defined in claim 9 in which the means providing the snug fit at the bottom end of the leg warmer comprises a first, elongated, vertically extending patch of a pile-type fastener material extending upwardly from the bottom end of the panel at the first edge thereof, a flap extendable from the second edge of the panel into overlying relationship with said first patch of pile-type fastener material, and a second, cooperating, also elongated and vertically extending patch of pile-type fastener material fixed to that side of the flap facing the first patch of pile-type fastener material.

11. A leg warmer as defined in claim 9 in which the closure system comprises a zipper with two slides, a first row of teeth extending along the first edge of the panel, and a second row of teeth extending along the second edge of the panel, said slides being vertically and independently displaceable relative to said panel to interengage and disengage the teeth of the first and second rows so that one or both of said slides can be so manipulated as to disengage selected segments of said rows of teeth and thereby provide a ventilation gap or gaps through which air can circulate to the leg of the wearer.

12. A leg warmer which comprises:

a wrap around panel dimensioned to extend from the foot to the crotch of the wearer and to completely surround the wearer's leg, said panel being fabricated entirely of flexible materials, comprising at least one layer of thermal insulation, and having a top end and a bottom end and first and second, completely separable edges extending from the bottom end to the top end of the panel; and a closure system for so continuosly joining the vertically extending edges of said panel together that said panel can be wrapped around the wearer's leg and said closure means then employed to provide a seam which is resistant to the passage of cold air and moisture between the first and second, vertically extending edges of the panel from the bottom end of the leg warmer to the top end thereof, said closure system including first means fixed to said panel at the first edge of the panel and extending downwardly toward the bottom end of the panel and second, cooperating means fixed to the panel at the second edge thereof and also extending downwardly toward the bottom end of the panel;

said closure system comprising a zipper with two slides, a first row of teeth extending along the first edge of the panel, and a second row of teeth extending along the second edge of the panel, said slides being vertically and independently displaceable relative to said panel to interengage and disengage the teeth of the first and second rows so that one or both fo said slides can be so manipulated as to disengage selected segments of said rows of teeth and thereby provide a ventilation gap or gaps through which air can circulate to the leg of the wearer.

* * * * *